US007731193B2

(12) United States Patent
Fabre

(10) Patent No.: US 7,731,193 B2
(45) Date of Patent: Jun. 8, 2010

(54) DOUBLE DEAD MAN GUTS

(76) Inventor: Steve Fabre, 3635 Olympic Blvd., University Place, WA (US) 98466

( * ) Notice: Subject to any disclaimer, the term of this patent is extended or adjusted under 35 U.S.C. 154(b) by 373 days.

(21) Appl. No.: 11/731,281

(22) Filed: Mar. 30, 2007

(65) Prior Publication Data

US 2008/0237986 A1 Oct. 2, 2008

(51) Int. Cl.
*A63F 1/00* (2006.01)

(52) U.S. Cl. ..... 273/274; 273/292

(58) Field of Classification Search ..... 273/274, 273/292; 463/12, 13

See application file for complete search history.

(56) References Cited

U.S. PATENT DOCUMENTS

| | | | | |
|---|---|---|---|---|
| 5,314,194 | A | 5/1994 | Wolf | 273/292 |
| 5,632,487 | A | 5/1997 | Nguyen | 273/292 |
| 6,234,485 | B1 | 5/2001 | Perkins | 273/292 |
| 6,302,398 | B1 | 10/2001 | Vecchio | 273/292 |
| 6,332,614 | B1 * | 12/2001 | Hesse | 273/292 |
| 6,443,455 | B1 * | 9/2002 | Webb | 273/274 |
| 6,461,240 | B1 | 10/2002 | Perkins | 463/13 |
| 6,554,702 | B2 | 4/2003 | Mahar et al. | 463/11 |
| 6,585,587 | B2 * | 7/2003 | Falciglia, Sr. | 463/13 |
| 6,705,612 | B1 | 3/2004 | Fousteris | 273/274 |
| 6,837,494 | B2 | 1/2005 | Lee | 273/292 |
| 6,863,275 | B2 | 3/2005 | Chiu et al. | 273/302 |
| 6,871,856 | B1 | 3/2005 | Rozboril | 273/292 |
| 6,874,785 | B2 | 4/2005 | Miller | 273/292 |
| 6,889,981 | B2 | 5/2005 | Parker | 273/292 |
| 6,902,167 | B2 | 6/2005 | Webb | 273/292 |
| 7,017,908 | B1 | 3/2006 | Tan et al. | 273/292 |
| 7,118,111 | B1 | 10/2006 | Altomare | 273/292 |
| 7,118,112 | B2 | 10/2006 | Kenny et al. | 273/292 |
| 7,121,550 | B1 | 10/2006 | Lo | 273/292 |
| 7,137,630 | B2 | 11/2006 | Yurkins | 273/292 |
| 7,140,614 | B2 | 11/2006 | Snow | 273/274 |
| 7,147,227 | B2 | 12/2006 | Taghavi | 273/292 |
| 7,165,770 | B2 | 1/2007 | Snow | 273/292 |
| 7,172,198 | B2 | 2/2007 | Parham | 273/292 |
| 7,407,163 | B2 * | 8/2008 | Snow | 273/292 |

OTHER PUBLICATIONS

"Guts Poker Games," http://www.checknraisepoker.com/about/games_and_rules-guts_poker, downloaded Feb. 8, 2007, 1 page.

(Continued)

*Primary Examiner*—William M Pierce
(74) *Attorney, Agent, or Firm*—Woodcock Washburn LLP

(57) ABSTRACT

In a guts game variation, one or more players play against one another and a sole participant must beat two "dead man" hands to win. For example, each player bets the ante and is dealt a hand of two cards. Each player is then given the option to participate in the hand or withdraw. All participating hands are revealed by turning the cards face-up. The player with the highest hand collects the pot, and all other participating players must put into the pot an amount equal to the value of winner's pot. When only one participant has elected to remain in the hand, the participant must beat both "dead man" hands in order to win the pot. The game ends when a sole participant beats both "dead man" hands, whereupon the cards are reshuffled and re-dealt to commence a new round of play.

29 Claims, 2 Drawing Sheets

OTHER PUBLICATIONS

HomePoker.com, "Over 1,000 home poker games and variations: Basic Guts," http://www.homepoker.com/games01.asp?group=guts&IDS=44, downloaded Feb. 8, 2007, 3 pages.

Poker.com, "Guts Poker Games," http://www.poker.com/game/guts-poker-games/, Downloaded Feb. 8, 2007, 5 pages.

* cited by examiner

DOUBLE DEAD MAN GUTS

FIELD OF THE INVENTION

The present invention generally relates to card games and, in particular, to card games for use in casinos and cardrooms. The invention relates to games that use standard rules of "guts" poker and preferably a standard deck of playing cards. More specifically, the method of the present invention is an enhancement to a game of guts poker by requiring a sole participant to beat two "dead man" hands to win the pot.

BACKGROUND

The present invention relates to gaming and to card games. In particular, the present invention pertains to a method of playing a new type of "guts" card game especially adapted for casino and card room gaming.

A wide variety of wagering games presently exist for casino and cardroom environments. Such games should be exciting and easy to learn so as to promote a stimulating gaming experience. Card games such as poker and blackjack have gained widespread popularity because of their established ranking of hands and well-known rules. Furthermore, each of these games usually involves numerous wagering opportunities for the players, thus increasing player participation and excitement. Lastly, the games move fairly quickly to maintain action and activity. All of these factors have created games that are widely accepted and widely known.

Gaming establishments also require innovative and exciting games to offer their clients. Distinctive new games are important in maintaining a casino's customer base as well as attracting new clients. Furthermore, casinos seek games that are easy to play and deal and that also maximize the amount of play, for example by increasing the number of hands per hour. Popular casino poker games such as "Let It Ride," "Texas Holdem," and "Red Dog" are examples of such games that are faster than the traditional poker room type game.

Guts is a genre of poker game that typically involves a greater potential for large pot sizes. Most guts games generally follow a similar pattern: after each player is dealt a hand, players decide if they are "in" or "out" of the hand. Those players that call "out" have no further stakes in the hand and are out of the game for that hand, while those players that called "in" continue playing. Of those players who called "in," the one who has the highest hand collects the pot. All other players who called "in" and did not beat the highest hand must match the amount of money in the pot. The result is an equal or greater amount of money in the pot for the next round of play. Play continues until only one player calls "in" and wins the pot. The size of the pot in a guts poker game can be much higher than typical poker games. For example, if three people call "in," the amount of money in the pot will double because one person will win the pot, while the other two must match the pot. For this reason, guts games are typically more expensive to play but are more exciting for players because of the greater potential for winnings.

Casinos also like guts games because of the greater potential for "rakes," in which the house takes a small amount of each pot won as a fee for providing the gaming service. Other variations of the basic guts game include Monte Carlo, Two And One, and Four Three.

In traditional guts poker, the player closest to the dealer normally has an advantage because that player can see how many players have opted to participate in the game. If no other player is willing to participate, the last player can remain in and win the pot even with a weak hand. In order to eliminate this advantage, a variation of guts called the "kitty" is used.

The kitty is a blind hand dealt face down that belongs to the pot and not revealed to the table until the hand is over. If the guts poker game involves two cards being dealt to each player, then a two-card kitty is dealt as well, kept near the dealer, and only turned up at the end of the hand. The purpose of the kitty is so that those players who go "in" must not only beat the other players who have gone "in," but they must also beat the kitty's hand. The feature that this adds to the guts game is that if the kitty has the best hand at the table, everybody who went "in" loses and matches the pot. The game ends only when one person goes "in" and also beats the kitty.

A drawback of the kitty is that the kitty comes into play every hand. This means that the cards must be reshuffled each hand. The same problem exists in each of the above listed popular guts poker games, where each game only deals one hand to a player and before requiring a shuffle. Players who are not "in" the hand get bored waiting for the constant shuffling before they get to see a new hand. Furthermore, the length of games before a single player wins the pot is often too short, in particular when fewer players are at the table. Finally, there is a constant need for the casino to increase a game's "hands per hour" to increase the casino rake.

As mentioned above, casinos have a need to offer new and exciting games to offer their players. While guts poker offers the opportunity for large pot sizes and exciting play, existing guts games do not offer speed of delivery to the players. Therefore, a new, more efficient, and more exciting method of playing guts is needed.

The game of "Double Dead Man Guts" addresses these problems by introducing the feature of two "dead man" hands that a player must beat before winning the pot. If no player wins the pot, new hands are dealt without a reshuffle, thus increasing the speed of the game. Time is saved by not having to shuffle as frequently. The players are happier because they get hands to them more quickly. Finally, more hands means more rakes per hour for casinos and card rooms.

SUMMARY

The present specification discloses a guts game variation in which one or more players play against one another. More generally, the disclosure is directed to a guts poker game variant in which a sole participant must beat two "dead man" hands to win. In a preferred embodiment, each player bets the ante and is dealt a hand of two cards. Each player is then given the option of participating in the hand or withdrawing. All participating hands are revealed by turning the cards face-up. The player with the highest hand collects the pot, and all other participating players must match the pot. The result is that the pot has grown by the number of participants who have lost, multiplied by the amount of the winner's pot.

When only one participant has elected to remain in the hand, the participant must beat both "dead man" hands in order to win the pot. The game ends when a sole participant beats both "dead man" hands. At this point, the cards are reshuffled and re-dealt to commence a new round of play.

BRIEF DESCRIPTION OF THE DRAWINGS

The foregoing summary, as well as the following detailed description of the invention, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF ILLUSTRATIVE EMBODIMENTS

Figure 1:
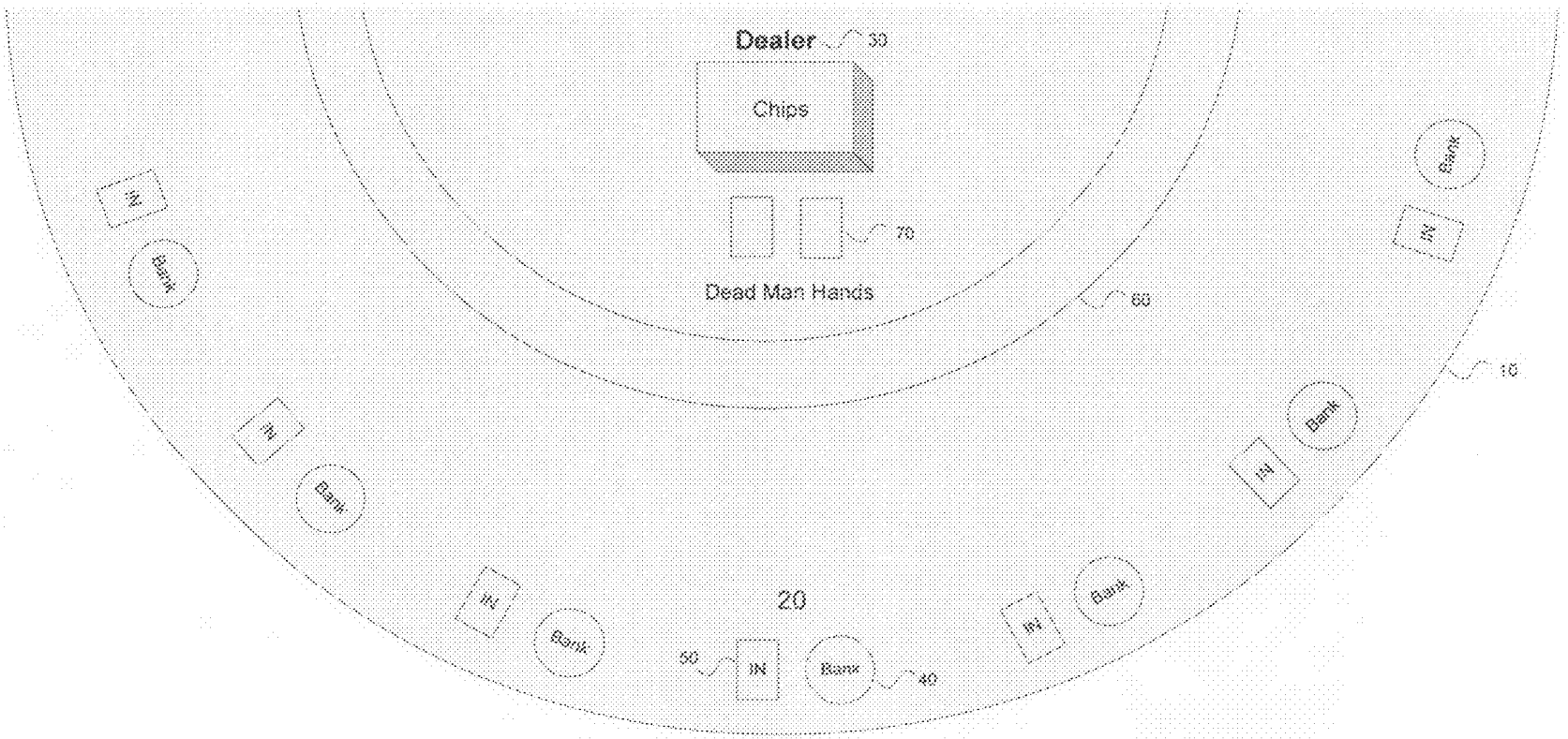
FIG. 1 shows a playing surface for use in playing a card game of one embodiment of the present invention.

According to a preferred embodiment of the present invention, players play in a casino or a poker card room. A casino is defined herein as any facility or establishment, public or private, that accommodates gambling or other forms of entertainment. Examples of casinos include, but are not limited to: hotels, restaurants, cruise ships, card rooms, and other leisure attractions. FIG. 1 shows a playing surface or table layout 10 on which one embodiment of the present invention is played. The layout 10 may be marked or placed on any suitable surface such as a gaming table. For example, the layout may be in the form of a layout cloth supported on a supporting surface. The layout provides a playing area 20 for a plurality of players, for example seven players, and a separate area 30 for a banker and/or dealer. Each playing area 20 has a number of marked sections or zones. Area 40 is the "bank" area and is where players who participate in a hand will "bank" the amount of the pot in the event that they participate and lose. Area 50 is the "in" area where a player is given his cards by the dealer. The cards will remain in the area as long as the player is "in" the hand. Area 60 is the "muck" where players who opt out of a hand will discard their cards. Area 70 is located in front of the house dealer position and is where the two dead man hands are placed.

Each player takes a place at one of the playing areas 20. The game is played in a number of rounds as will be described. In each round, each player has the option of participating in the hand or withdrawing and waiting for the next hand. In other variations of the game, each player may have the opportunity to make additional side bets. Alternatively, the casino or poker room may offer a number of jackpots if a player receives a certain hand or series of hands. The preferred embodiment of the present invention is played with a standard deck of 52 playing cards.

Figure 2:
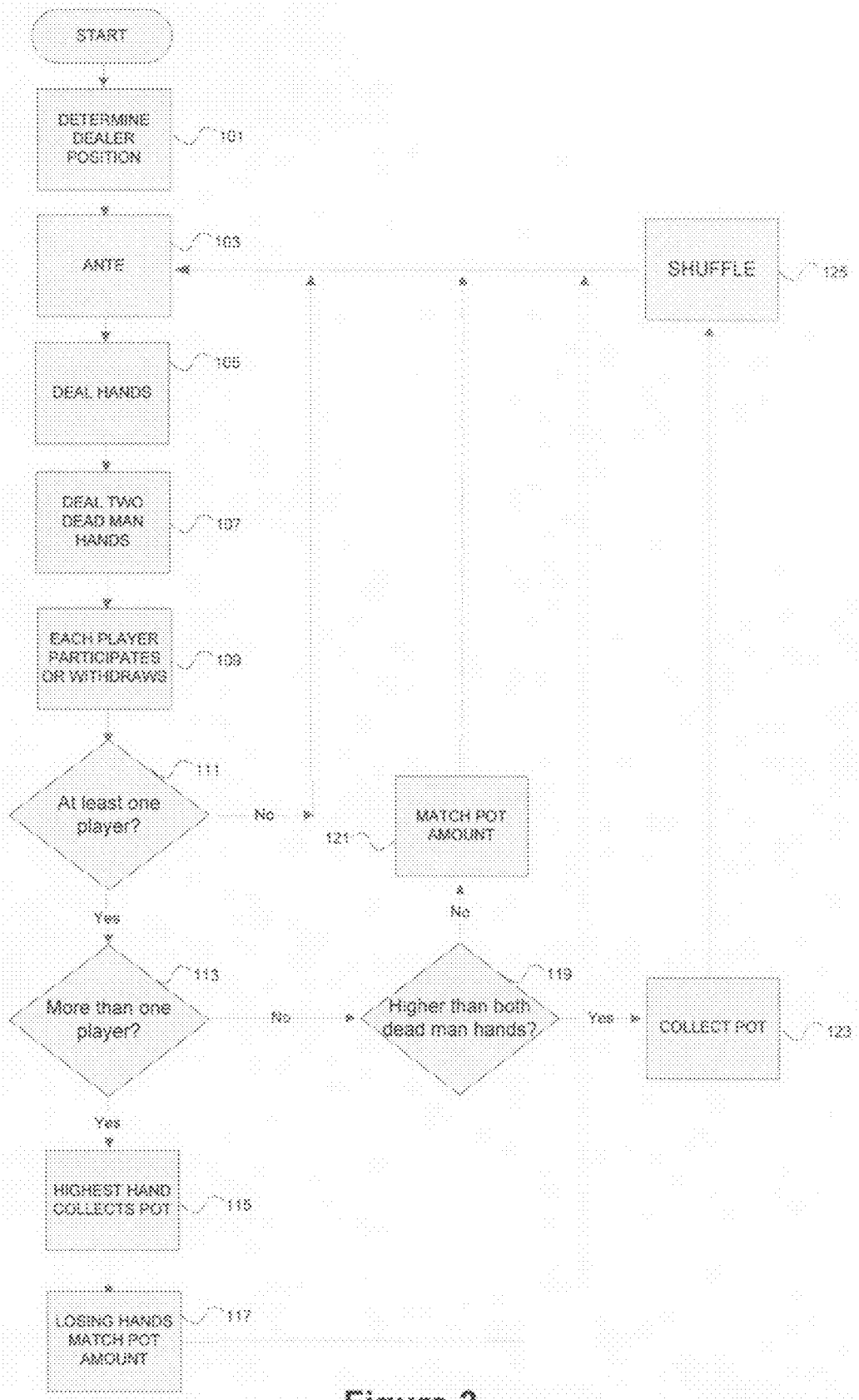
FIG. 2 is a flow diagram illustrating aspects of a method of a preferred embodiment.

Referring now to FIG. 2, preferably at step 101, the first dealer position is determined. The house dealer provides a deck of cards, from which each player selects one card. The player selecting the high card is designated the "dealer" and a dealer button is placed at the player's area 20. The dealer button moves clockwise with each subsequent dealing of cards.

At step 103, each player sitting at the table choose to ante or sit out. The ante is typically set by the house and will be the same for each player. For example, at a $5.00 table each player will place an ante of $5.00 to participate in that hand. Players who do not pay the ante must sit out the hand At step 105, beginning with the player next to the player with the dealer button, the dealer deals each player a hand of cards face down. In a preferred embodiment, each player hand is comprised of two cards, The house typically publishes a ranking of winning hands. In one embodiment, a ranking of two card hands ranked from highest to lowest is as follows:

(a) straight flush (b) pair (c) straight (d) flush (e) high card.

Other hand rankings are possible and may be used to introduce new combinations and make the game more interesting. Furthermore, variations in rankings within each of the above ranking categories may be provided. For example, in one embodiment an ace-deuce straight flush can be ranked higher than a queen-king straight flush. In another embodiment, an ace-deuce straight can be ranked higher than a queen-king straight. Such variations require revised player strategies and make the game more entertaining to play.

In step 107 the two dead man hands are dealt face down in the dealer area at location 70. In a preferred embodiment the two dead man hands are dealt when the house dealer position is reached during the course of dealing hands to each player. For example, when dealing clockwise, the dead man hands would be dealt immediately after a hand is dealt to the player to the right of the house dealer position. After dealing the two dead man hands in the dealer area at location 70, then a hand is dealt to the player to the left of the house dealer position, and so on until all participating players are dealt a hand.

In step 109, beginning with the player left of the dealer and moving clockwise, each player is given the option to participate in the hand or to withdraw. A player who decides to withdraw will throw his cards in the muck area 60. The remaining players who are participating in the hand leave their cards in the "in" area 50. Furthermore, each player who decides to participate must also "bank" the amount in the pot to participate. The player banks the amount by wagering an amount equal to the current value of the pot and placing the amount in the player's bank area 40.

In step 111, if no player decides to participate in that hand, the game returns to step 103, where each player must ante to participate and be dealt another hand. At step 105, no shuffle is required as long as there are sufficient cards to deal one hand to each player. Otherwise, the cards are shuffled and the players are dealt new hands from the shuffled deck.

If there is at least one player who has not thrown her cards into the muck, then the game next turns to step 113 where it is determined if there is more than one player who is participating in the hand. If there is more than one player, then the game moves to step 115 wherein all participating hands are revealed by each player turning their cards face-up. According to the ranking of hands described above, the player with the highest hand among the participating hands is declared the winner and collects the pot. The house can rake the house rake fee at this point. In one embodiment, if the two highest hands are identical, then both players are declared the winner and split the amount of the pot.

Next in step 117 all other participating players who did not win the pot must match, or add to the pot, the amount That was banked in step 109. The result is that the pot has now grown to an amount equal to the number of players who have lost in the current hand, multiplied by the amount taken by the winner of the hand. This amount now comprises the new pot for the next round of play. The game then returns to step 103.

If in step 113 only one player participates in the hand, the game then turns to step 119 where the two "dead man" hands are revealed. If the player's hand beats both dead man hands, then the game moves to step 123 where the player is declared the winner. The player collects the amount in the pot, and the game turns to step 101. The cards are collected, shuffled, and play turns to step 103. If the player fails to beat both dead man hands, the game moves to step 121 where the player must match the amount banked in step 109.

In one embodiment of the invention, if the player's hand is identical in ranking to the higher of the two dead man hands, then the dead man hand is declared the winner and the player must match the pot. The game then returns to step 103. If the player's hand is higher than either of the two dead man hands, then he is declared the winner and collects the pot in step 123. Since there is no losing player to replenish the pot, the game ends and the cards are shuffled in step 125. The game then turns to step 103, and a new round of play is commenced, whereupon any player who wishes to participate can bet the ante.

In another embodiment of the invention, the house may limit the "match the pot" value to a predetermined amount. For example, a player who participates and loses will only have to match the pot up to the limit of $25, even if the value of the pot is $50. The value of the pot can continue to increase beyond the "match the pot" limit. In yet another embodiment, if the "match the pot" amount is limited to $25, then a winning hand would only collect $25 even if the value of the pot was $50. The remaining amount of $25 would remain in the pot for the next round.

In another embodiment of the invention, the house may offer one or more jackpots for players who are dealt a predetermined hand or a sequence of hands. The house would publish a predetermined ranking of hands and winning amounts for such jackpots.

EXAMPLES

Example 1

From a standard 52 card deck, five player hands are dealt two cards each (face down) at a table where each of the five players have placed a $5.00 ante wager. The dealer has also dealt two dead man hands of two cards each face down. The pot has a value of $25. The players examine their individual hands and make decisions on whether they want to participate in that hand (and risk having to match the $25 pot) or wait for the next hand (and risk losing their $5.00 ante wager if a player stays in the game and wins the pot).

Player 1 has cards of 6 of Clubs and 5 of Clubs. According to the example ranking above, the player has the highest ranking hand comprising a straight flush, and chooses to participate in the game.

Player 2 has a 9 of Hearts and King of Spades. The player only has a high card of a king, and will likely throw his cards in the muck.

Player 3 has a 8 of Diamonds and a 8 of Spades. The player has a pair which is one of the higher ranking hands, and will likely remain active in the round.

Player 4 has an Ace of Clubs and King of Diamonds. The player has a straight which is a moderately ranked hand. However, the player sees that two other players have remained active, and will consider whether the hand is sufficiently competitive to remain active in the round. Since the value of the straight is high due to the Ace, the player will likely remain in the round.

Player 5 has an 8 of Hearts and 6 of Hearts. The player has a flush which is a moderately ranked hand. However, the player sees that three other players have remained active, and will consider whether the hand is sufficiently competitive to remain active in the round. Since the value of the flush is among the lower hands, the player will likely opt out of the round.

The players reveal their hands at this time. The exposed cards show that player 1 has the highest hand, and player 1 will therefore collect $25 (minus the house rake). Players 1, 3 and 4 must match the pot and pay $25 each into the pot. The value of the pot is now $75. Each player antes to receive a new two card hand, and the game continues.

Example 2

In this example, there are five players as in Example 1. However, only player 1 has stayed in the game with an Ace of Clubs and King of Diamonds. At this point, the two dead man hands are revealed. The first dead man hand reveals an 8 of Hearts and a 2 of Clubs. The second dead man hand reveals a 7 of Diamonds and a 6 of Clubs which is ranked as a straight. However, Player 1's straight has a higher value than the straight held by the dead man. Therefore, Player 1 collects the $25 pot (minus the house rake). The cards are collected and shuffled, and a new game is commenced.

As noted, the above descriptions and examples are intended to be exemplary of broad and generic scopes of inventions and should not be seen as limiting the scope of the disclosure or the claims. Alternative, additional and optional variations in the play of the game may be made without deviating from the concepts of the present invention as described and as claimed.

What is claimed:

1. A method of playing a guts poker game using one or more decks of playing cards, a dealer, two or more players, and a playing surface comprising a dealer area and a player area, the method comprising:

in a first round of play:

receiving on said playing surface a first ante from each of a first group of at least two players, wherein a sum of the received first antes constitutes a first pot;

dealing a hand comprising at least two playing cards to each of said first group;

dealing at least two additional hands face down in said dealer area to form at least two dead man hands;

providing each of said first group an option to participate in or withdraw from the first round of play;

determining a highest hand among participating players in accordance with a predetermined ranking of hands;

awarding a first winning pot to one of the participating players having said highest hand; and receiving on said playing surface a first amount equal to a first value of said first winning pot from each of said participating players not having said highest hand; and in the second round of play:

receiving on said playing surface a second ante from each of a second group of at least two players, wherein a sum of the received second antes and the received first amounts constitutes a second pot;

dealing hands to each of said second group;

providing each of said second group an option to participate in or withdraw from the second round of play;

determining that only one player of said second group is participating in the second round of play and revealing said at least two dead man hands;

determining another highest hand among said only one player and said at least two dead man hands in accordance with the predetermined ranking of hands; and awarding a second winning pot to said only one player when the only one player's hand is determined to be the another highest hand, and otherwise:

receiving on said playing surface a second amount equal to a second value of said second winning pot from said only one player and continuing additional rounds of play until a sole player wins a subsequent pot by beating said at least two dead man hands, whereupon said playing cards are collected for shuffling and wherein the playing cards are collected and shuffled when insufficient unshuffled cards remain for continued dealing.

2. The method of claim 1, further comprising:

determining a dealer position by distributing one of said playing cards to each of said two or more players and assigning the dealer position to a player with a highest ranked card; and moving the dealer position clockwise with each subsequent round of play.

3. The method of claim 1 wherein said guts poker game is played with at least one standard deck of 52 playing cards.

4. The method of claim 1 wherein said predetermined ranking from highest to lowest is as follows:

(a) straight flush (b) pair (c) straight (d) flush (e) high card.

5. The method of claim 1 wherein the participating players must bank said first amount in order to participate during said first round.

6. The method of claim 1 wherein said first winning pot is limited to a first predetermined amount.

7. The method of claim 6 wherein said one of the participating players having said highest hand collects said first predetermined amount, and a first remaining amount remains in the second pot for the second round.

8. The method of claim 1 wherein the participating players must bank said second amount in order to participate during said second round.

9. The method of claim 1 wherein said second winning pot is limited to a second predetermined amount.

10. The method of claim 9 wherein said awarding a second winning pot comprises awarding said second predetermined amount, and a second remaining amount remains for a subsequent round.

11. The method of claim 1 wherein said first winning pot is said first pot.

12. The method of claim 1 wherein said second winning pot is said second pot.

13. The method of claim 1 wherein each of said first group or second group wins a predetermined amount when dealt a predetermined hand or sequence of hands.

14. The method of claim 1 wherein two players are awarded one half of the first winning pot when said two players have identically ranked hands.

15. The method of claim 1 further comprising collecting and shuffling said one or more decks and commencing a third round of play.

16. The method of claim 1, wherein a hand ranked equally with a highest ranked one of said at least two dead man's hands is deemed a losing hand.

17. The method of claim 1, wherein said only one player receives half the second winning pot when the only one player's hand and a highest hand among said at least two dead man hands are identically ranked.

18. A method of playing a guts poker game using one or more decks of playing cards, a dealer, two or more players, and a playing surface comprising a dealer area and a player area, the method comprising:

receiving on said playing surface an ante from each of said two or more players, wherein a sum of the received antes constitutes a pot;

dealing a hand comprising at least two playing cards to each of said two or more players;

dealing at least two additional hands face down in said dealer area to form at least two dead man hands;

providing each of said two or more players an option to participate in or withdraw from a current round of play;

determining that only one player of said two or more players is participating in the current round of play and revealing said at least two dead man hands;

determining a highest hand among said only one player and said at least two dead man hands in accordance with a predetermined ranking of hands; and awarding a winning pot to said only one player when the only one player's hand is determined to be the highest hand, and otherwise receiving on said playing surface an amount equal to a value of said winning pot from said only one player.

19. The method of claim 18, further comprising:

determining a dealer position by distributing one of said playing cards to each player and assigning the dealer position to a player with a highest ranked card; and moving the dealer position clockwise with each subsequent round of play.

20. The method of claim 18, wherein said game is played with at least one standard deck of 52 playing cards.

21. The method of claim 18, wherein said predetermined ranking from highest to lowest is as follows:

(a) straight flush (b) pair (c) straight (d) flush (e) high card.

22. The method of claim 18, wherein the participating players must bank said amount in order to participate.

23. The method of claim 18, wherein said winning pot is limited to a predetermined amount.

24. The method of claim 23, wherein said awarding comprises awarding the winning pot to said only one player when the only one player's hand is determined to be the highest hand, and a remaining amount remains in a next pot for a next round.

25. The method of claim 18, wherein said winning pot is said pot.

26. The method of claim 18, wherein a hand ranked equally with a highest ranked one of said at least two dead man's hands is deemed a losing hand.

27. The method of claim 18, wherein each of said at least two players wins a predetermined amount when dealt a predetermined hand or a sequence of hands.

28. The method of claim 18, wherein said only one player receives half the winning pot when the only one player's hand and a highest hand among said at least two dead man hands are identically ranked.

29. method of claim 18, further comprising collecting and shuffling said one or more decks and commencing a next round of play.

* * * * *

UNITED STATES PATENT AND TRADEMARK OFFICE

CERTIFICATE OF CORRECTION

PATENT NO. : 7,731,193 B2
APPLICATION NO. : 11/731281
DATED : June 8, 2010
INVENTOR(S) : Steve Fabre It is certified that error appears in the above-identified patent and that said Letters Patent is hereby corrected as shown below:

Column 8, line 57, Claim 29, line 1, insert --The-- before "method."

Signed and Sealed this

Fourteenth Day of September, 2010

David J. Kappos

David J. Kappos
*Director of the United States Patent and Trademark Office*